US009789504B2

(12) United States Patent
Quennessen

(10) Patent No.: US 9,789,504 B2
(45) Date of Patent: Oct. 17, 2017

(54) FRAGRANCE DISPENSER

(71) Applicant: Coty Inc., New York, NY (US)

(72) Inventor: Bernard Quennessen, New York, NY (US)

(73) Assignee: Coty Inc., New York, NY (US)

( * ) Notice: Subject to any disclaimer, the term of this patent is extended or adjusted under 35 U.S.C. 154(b) by 0 days.

(21) Appl. No.: 14/991,580

(22) Filed: Jan. 8, 2016

(65) Prior Publication Data

US 2016/0199864 A1 Jul. 14, 2016

Related U.S. Application Data

(60) Provisional application No. 62/101,691, filed on Jan. 9, 2015.

(51) Int. Cl.
*B05B 11/00* (2006.01)
*A45D 34/02* (2006.01)

(52) U.S. Cl.
CPC ..... *B05B 11/3084* (2013.01); *B05B 11/3052* (2013.01); *B05B 11/3083* (2013.01); *A45D 34/02* (2013.01); *A45D 2200/057* (2013.01); *B05B 11/0037* (2013.01)

(58) Field of Classification Search
CPC ..... B05B 11/0037; B05B 11/3052; B05B 11/3083; B05B 11/3084; A45D 34/02
See application file for complete search history.

(56) References Cited

U.S. PATENT DOCUMENTS 4,687,663 A 8/1987 Schaeffer
5,169,029 A * 12/1992 Behar ..... B05B 11/3084 128/200.23
5,224,627 A 7/1993 Weag
(Continued)

FOREIGN PATENT DOCUMENTS

WO WO-2016/112325 A1 7/2016

OTHER PUBLICATIONS

"International Application Serial No. PCT/US2016/012705, International Search Report mailed Apr. 19, 2016", 3 pgs.
(Continued)

*Primary Examiner* — J. Casimer Jacyna
(74) *Attorney, Agent, or Firm* — Schwegman Lundberg & Woessner, P.A.

(57) ABSTRACT

Inventive embodiments disclosed herein refer to a fragrance dispenser. The fragrance dispenser includes an enclosure having a base and a top portion, including a spray actuator. The fragrance dispenser also includes two or more bottles enclosed in the enclosure, each bottle having a top pump portion and a bottom portion. Two or more fragrances are enclosed in the two or more bottles, one fragrance per bottle. Two or more pumps, one pump per bottle are positioned within the pump portion of each of the two or more bottles. A manifold includes connector passages that connect all of the pumps to the spray actuator. At least two cams, both of which are enclosed by the enclosure are positioned adjacent the base of the enclosure, wherein the two cams together contact all of the two or more bottles, wherein movement of the cams produces movement of one or more of the pumps up or down. The fragrance dispenser also includes one or more dials for adjusting the position of each of the cams.

19 Claims, 4 Drawing Sheets

(56) References Cited

U.S. PATENT DOCUMENTS

| | | | | |
|---|---|---|---|---|
| 5,568,883 | A | 10/1996 | Cataneo | |
| 2007/0051749 | A1 | 3/2007 | Fleet et al. | |
| 2009/0216183 | A1 | 8/2009 | Minotti | |
| 2012/0279990 | A1* | 11/2012 | Werner | B05B 11/3083 222/132 |
| 2013/0299514 | A1* | 11/2013 | Holzmann | B05B 11/3084 222/134 |

OTHER PUBLICATIONS

"International Application Serial No. PCT/US2016/012705, Written Opinion mailed Apr. 19, 2016", 5 pgs.

* cited by examiner

FRAGRANCE DISPENSER

FIELD

Inventive embodiments disclosed herein relate to a fragrance dispenser and to a method for adjusting fragrance.

BACKGROUND

Fragrance has been described as having three sets of notes that make a harmonious scent accord. The notes unfold over time, with the first impression of the top note followed by deeper middle notes, and base notes appearing last. The olfactory and psychological sensation of a user depends, in part, on the user's mood when she or he is wearing the fragrance.

Scents that are perceived immediately upon application of a perfume are top notes. Top notes typically include molecules that evaporate quickly. Top notes form a user's initial impression of a fragrance. Heart notes form the main body, i.e. middle notes, of the fragrance. Base notes are typically not perceived until about thirty minutes from application of the fragrance. Base notes tend to be more complex than top notes or middle notes. Changes made in each of the notes impart change in scent to the other notes as well.

SUMMARY

Inventive embodiments disclosed herein refer to a fragrance dispenser. The fragrance dispenser includes an enclosure having a base and a top portion opposing the base, the top portion terminating in a spray actuator. The fragrance dispenser also includes two or more bottles enclosed within the enclosure, each bottle having a top pump portion and a bottom portion. Two or more fragrances are enclosed in each of the two or more bottles, one fragrance per bottle. Two or more pumps, one pump per bottle are positioned within the top pump portion of each of the two or more bottles. A manifold having connector passages detachably connects all of the pumps to the spray actuator. At least one cam is enclosed by the enclosure and is positioned adjacent the base of the enclosure. The cam contacts at least one of the bottles. Movement of the cam produces movement of one or more of the pumps and changes the length of the pump stroke. The fragrance dispenser also includes one or more dials for adjusting the position of each of the cams.

DETAILED DESCRIPTION

Figure 1:
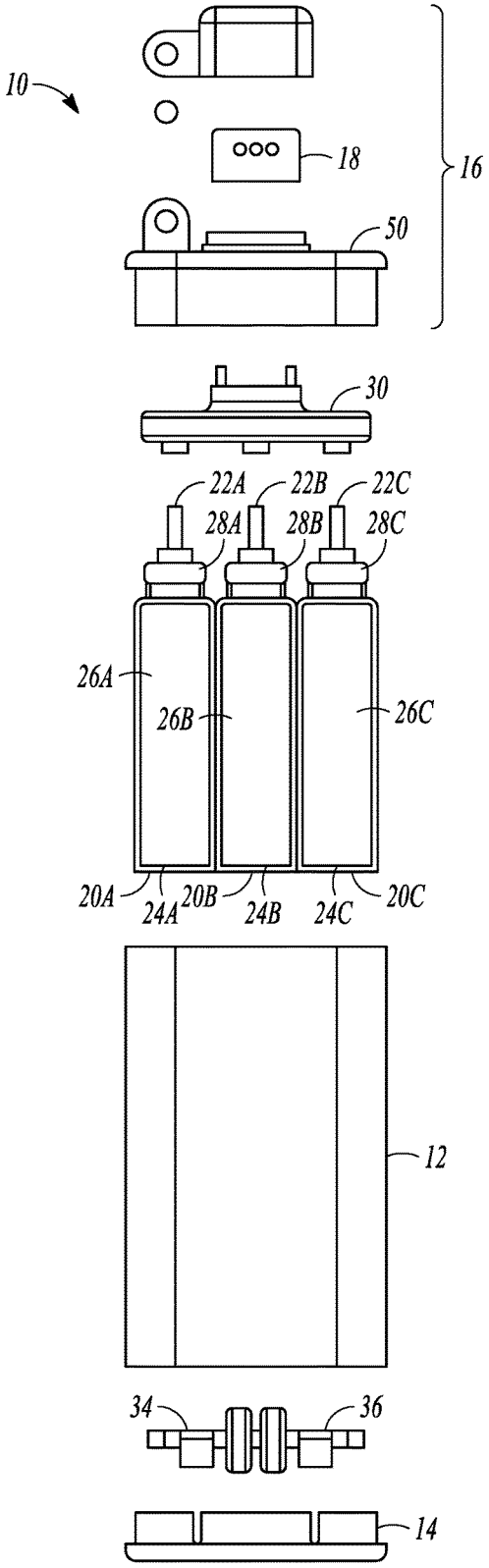
FIG. 1 is an exploded view of one embodiment of the fragrance dispenser of the present invention.
Figure 2:
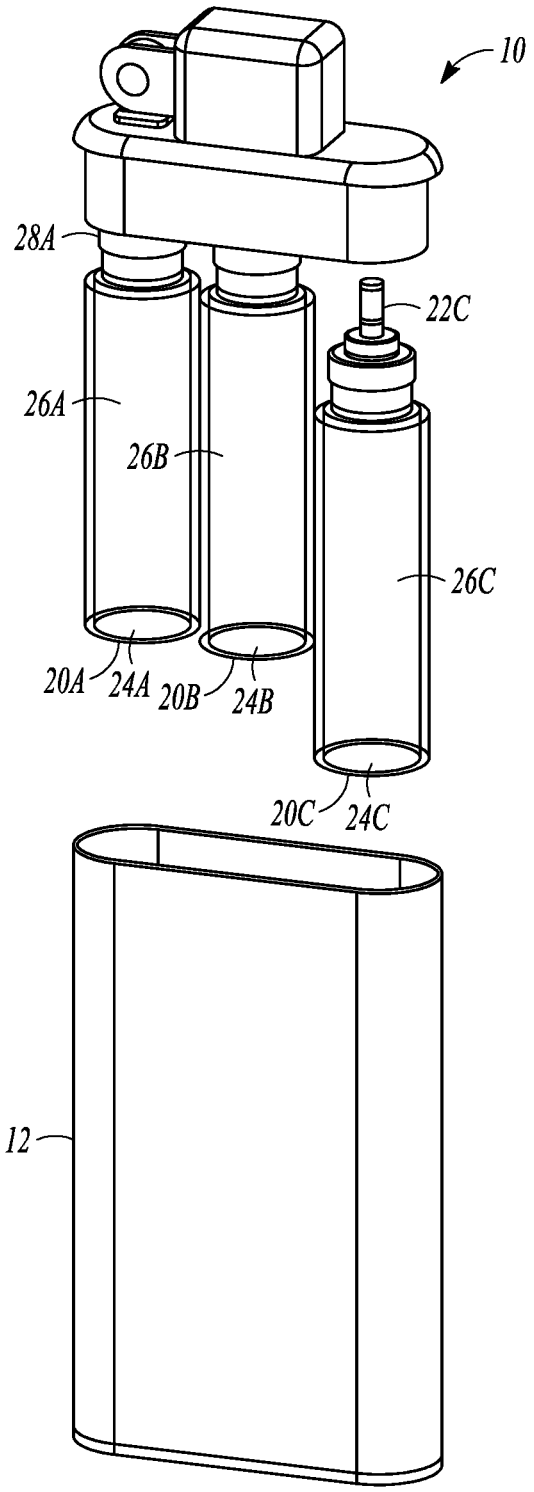
FIG. 2 is a perspective view of the fragrance dispenser of FIG. 1, wherein bottles of the fragrance dispenser are removable and replaceable.
Figure 3A:
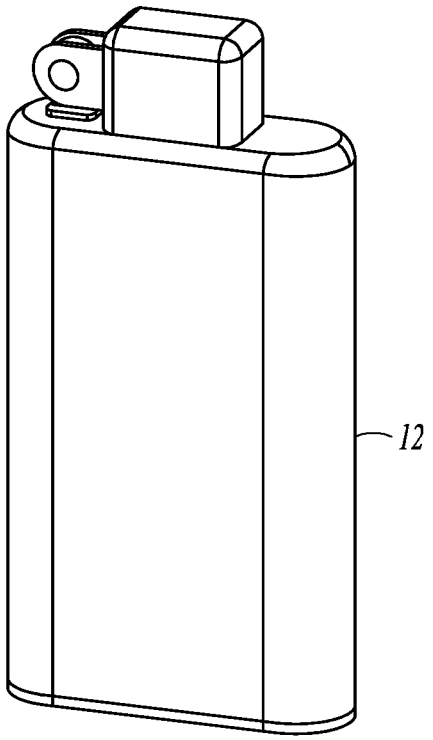
FIG. 3A is a perspective view of the fragrance dispenser of FIG. 1 with a cover enclosing a spray actuator.
Figure 3B:
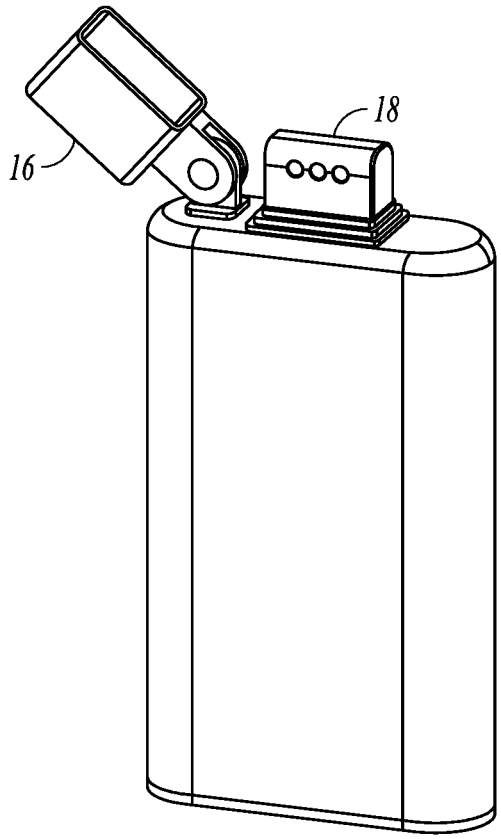
FIG. 3B is a perspective view of the fragrance dispenser of FIG. 3A with the cover in a closed position.
Figure 3C:
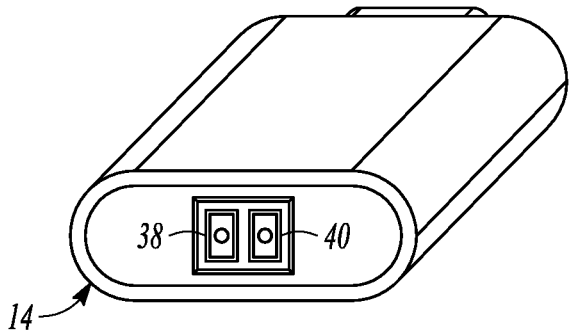
FIG. 3C is a perspective view illustrating the base of the dispenser and two dials.
Figure 4:
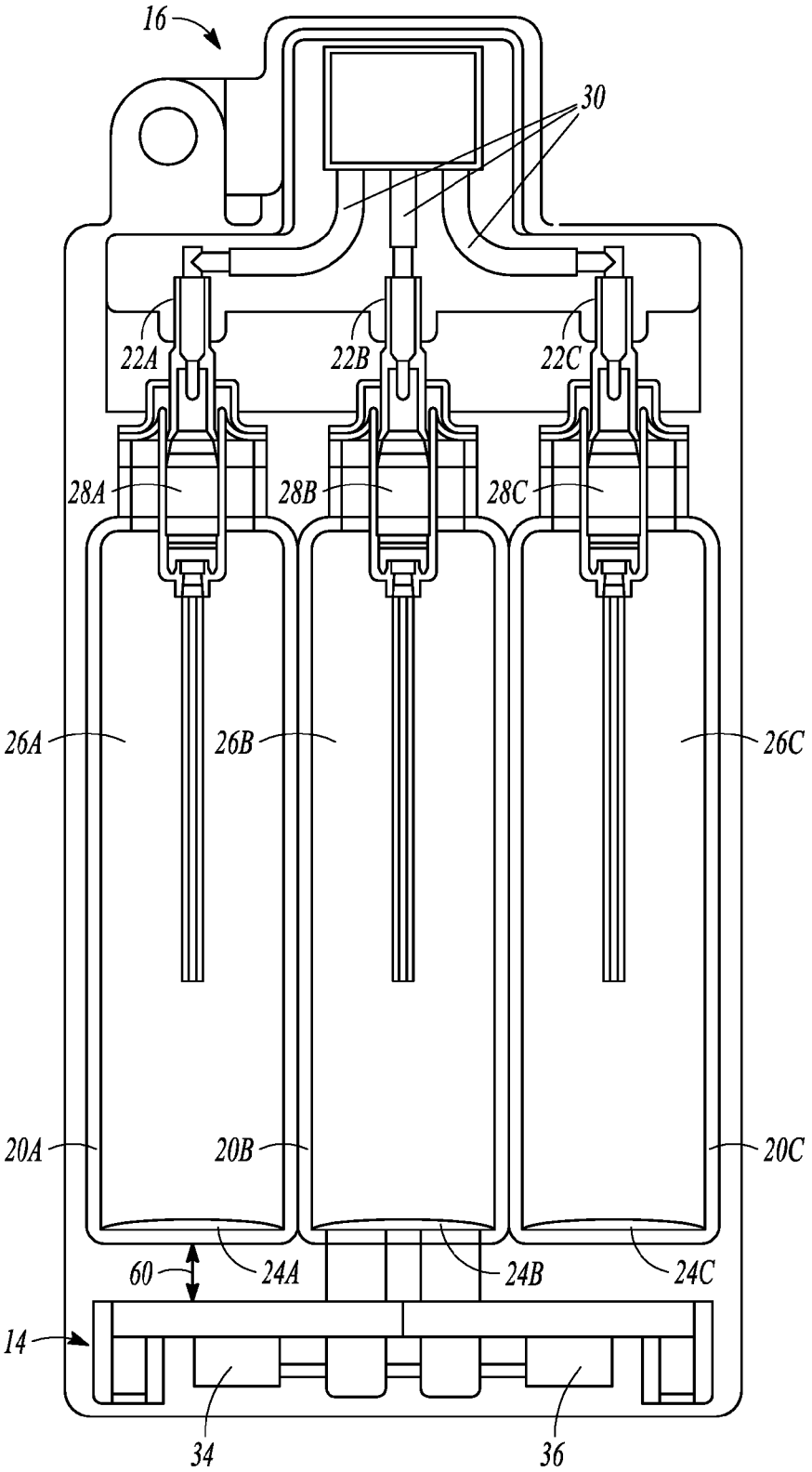
FIG. 4 is a side cross-sectional view of the fragrance dispenser of FIG. 1.

Inventive embodiments disclosed herein include a fragrance dispenser, illustrated in an exploded view, generally at 10 in FIG. 1. The fragrance dispenser 10 includes an enclosure 12 having a base 14 and a top portion 16, terminating in a spray actuator 18. The top portion 16 of the enclosure 12 includes a collar 50. For some embodiments, the collar is an integral part of the enclosure 12 and for other embodiments, the collar is detachably coupled to the enclosure.

The fragrance dispenser 10 also includes two or more bottles, such as 20A, 20B and 20C, enclosed in the enclosure 12. Each bottle 20A, 20B, 20C, includes a top pump portion 22A, 22B and 22C and a bottom portion 24A, 24B and 24C, respectively. Two or more fragrances 26A, 26B and 26C are enclosed in the two or more bottles, one fragrance per bottle. Two or more pumps 28A, 28B and 28C, one pump per bottle are positioned within the pump portion 22A, 22B and 22C, respectively, of each of the two or more bottles 20A, 20B and 20C.

A manifold 30 includes connector passages 32A, 32B and 32C that detachably connect all of the pumps 28A, 28B and 28C, respectively, to the spray actuator 18. Two cams 34 and 36, both of which are enclosed by the enclosure 12 are positioned adjacent the base 14 of the enclosure 12, wherein the two cams 34 and 36 contact the bottles 20A and 20C, respectively, wherein movement of the cams 34 and 36 produces movement of one or more of the pumps 28A and 28C, up or down. The fragrance dispenser also includes dials 38 and 40 for adjusting the position of each of the cams. While two cams are shown in the figures herein, it is understood that other embodiments include one cam or more than two cams. While three bottles are shown, it is understood that other embodiments of the fragrance dispenser include two bottles or more than three bottles. While two dials are disclosed, it is understood that other embodiments include one dial or more than two dials.

To operate the embodiment illustrated in FIG. 1, a user turns the dials 38 and 40 at the bottom of the enclosure of the dispenser to adjust the fragrance notes to the user's personal choice. The user then presses the spray actuator 18 like other conventional fragrance spray bottles.

For the embodiment shown, there are two dials and four choice options for each dial, from 0 to 3, providing a total of 16 different fragrance variations possible. While two dials are shown herein, it is understood that some embodiments may include one dial and other embodiments may include more than two dials.

In one embodiment, three individual bottles 20A, 20B and 20C, are filled with fragrance and are each assembled with a spray pump 22A, 22B, and 22C, respectively. The three pumps are connected together by the manifold 30. The manifold 30 is assembled to the spray actuator 18.

The two individual rotatable cams 34 and 36 are situated below left and right bottles 20A and 20C and are assembled to the base 14 of the enclosure 12.

By rotating the dials 38 and 40 at the bottom of the enclosure, the attached cams 34 and 36 are also rotating leaving a gap 60. For one exemplary embodiment, the gap 60 varies from 0 mm to 6 mm, increments of 2 mm, between the top of the cams and the base of each bottle, depending upon the position of the cam. The gap between the top of the cam and base of bottle 20B stays constant, at 0 mm, regardless of the position of the cams 38 and 40. For other embodiments, the gap varies within distances other than 0 to 6 mm. Other embodiments are not confined to increments of 2 mm. The gap distance and increment values disclosed herein are presented as examples of the present invention and are not intended to limit the scope of the present invention.

When the user presses the actuator, the stroke of each pump will be the result of full pump stroke minus the gap between the top of the cams and the bottom of the bottles, adjusted by the user by moving the dials. If, for one embodiment, the full pump stroke is 6 mm and the gap is 2 mm, the final pump stroke is 6 mm−2 mm=4 mm. In this example, the pump delivers two-thirds of its full dosage.

All three fragrance spray dosages are collected and delivered to the actuator through the manifold. The spray delivered to the user is the sum of all three pump deliveries.

Between each spray, the dials are rotatable by the user to change the fragrance type output.

Because each bottle will not be emptied at the same rate, some fragrance dispenser embodiments include a mechanism for refilling or replacing an empty bottle when necessary. To do so, the user separates the collar from the enclosure, detaches the empty bottle and refills it or replaces it with a full one. Then, the user assembles the collar with the enclosure.

In various embodiments, the inventive composition or method can be any one of any of the combinations and/or sub-combinations of the above-listed embodiments.

While the invention has been described and exemplified in sufficient detail for those skilled in this art to make and use it, various alternatives, modifications, and improvements will be apparent to those skilled in the art without departing from the spirit and scope of the claims.

All patents and publications referred to herein are incorporated by reference to the same extent as if each individual publication was specifically and individually indicated to be incorporated by reference.

The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

What is claimed is:

1. A fragrance dispenser, comprising:

an enclosure having a base and a top portion, the top portion including a spray actuator;

two or more bottles enclosed in the enclosure, each bottle having a top pump portion and a bottom portion;

two or more fragrances enclosed in the two or more bottles, one fragrance per bottle;

two or more pumps, one pump per bottle, within the pump portion of each of the two or more bottles;

a manifold comprising connector passages that detachably connect all of the pumps to the spray actuator;

two cams, which are enclosed by the enclosure and positioned adjacent the base of the enclosure, wherein the cams contact at least one of the bottles, wherein movement of the cams produces movement of one or more of the pumps in accordance with length of the movement of the cams; and one or more dials for adjusting a position of each of the cams.

2. The fragrance dispenser of claim 1, wherein the cams move one or more of the bottles up or down.

3. The fragrance dispenser of claim 1, wherein a stroke of each of the pumps is movable in accordance to the positioning of each of the bottles by the position of the cams.

4. The fragrance dispenser of claim 3, wherein when the spray actuator is actuated, each of the pumps of the bottles delivers fragrance in accordance with a length of the stroke that is determined by the position of the cams.

5. The fragrance dispenser of claim 3 wherein a length of the stroke is variable.

6. The fragrance dispenser of claim 4 wherein the stroke length is variable.

7. The fragrance dispenser of claim 1, wherein the enclosure encloses three bottles.

8. The fragrance dispenser of claim 1, wherein the top portion of the enclosure comprises a collar and a cap, the cap hingedly movable over the spray actuator.

9. The fragrance dispenser of claim 8, wherein the collar, cap, spray actuator and manifold are detachable from the enclosure.

10. A fragrance dispenser, comprising:

an enclosure having a base and a top portion, the top portion including a spray actuator;

three bottles enclosed in the enclosure, each bottle having a top pump portion and a bottom portion;

three fragrances enclosed in the three bottles, one fragrance per bottle;

three pumps, one pump per bottle, within the pump portion of each of the three bottles;

a manifold comprising connector passages that detachably connect all of the pumps to the spray actuator;

two cams, which are enclosed by the enclosure and positioned adjacent the base of the enclosure, wherein each of the cams contacts one of the bottles, wherein movement of the cams produce movement of two of the pumps in accordance with length of the movement of each of the two cams; and two dials for adjusting a position of each of the two cams.

11. The fragrance dispenser of claim 10, wherein the three bottles include two outer bottles, adjacent the enclosure and an inner bottle.

12. The fragrance dispenser of claim 10, wherein the cams each contact one of the two outer bottles.

13. The fragrance dispenser of claim 10, further comprising three fragrances, one fragrance contained in each of the three bottles.

14. The fragrance dispenser of claim 12, wherein the two cams move the two outer bottles up or down.

15. The fragrance dispenser of claim 10, wherein when the spray actuator is actuated, each of the three pumps of the three bottles delivers fragrance in accordance with a stroke length determined by the cams' positions.

16. The fragrance dispenser of claim 10, wherein the top portion of the enclosure comprises a collar and a cap, the cap hingedly movable over the spray actuator.

17. The fragrance dispenser of claim 16, wherein the collar, cap, spray actuator and manifold are detachable from the enclosure.

18. A kit comprising:

The fragrance dispenser of claim 10 and one or more replacement bottles containing fragrance.

19. A kit comprising:

The fragrance dispenser of claim 1 and one or more replacement bottles containing fragrance.

* * * * *